US008877348B2

(12) United States Patent
Nishihara et al.

(10) Patent No.: US 8,877,348 B2
(45) Date of Patent: Nov. 4, 2014

(54) SURFACE-TREATED STEEL SHEET AND RESIN-COATED STEEL SHEET

(75) Inventors: Yuka Nishihara, Chiba (JP); Takeshi Suzuki, Chiba (JP); Noriko Makiishi, Chiba (JP); Takumi Tanaka, Fukuyana (JP); Hiroki Iwasa, Kawasaki (JP); Norihiko Nakamura, Chiba (JP); Kaoru Sato, Kawasaki (JP); Takashi Kawano, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 1051 days.

(21) Appl. No.: 12/739,959

(22) PCT Filed: Oct. 30, 2008

(86) PCT No.: PCT/JP2008/070255

§ 371 (c)(1),
(2), (4) Date: Aug. 9, 2010

(87) PCT Pub. No.: WO2009/057823

PCT Pub. Date: May 7, 2009

(65) Prior Publication Data

US 2010/0297465 A1 Nov. 25, 2010

(30) Foreign Application Priority Data

| | | |
|---|---|---|
| Oct. 31, 2007 | (JP) | 2007-282806 |
| Dec. 25, 2007 | (JP) | 2007-331329 |
| Jun. 27, 2008 | (JP) | 2008-168071 |
| Jun. 27, 2008 | (JP) | 2008-168072 |
| Jun. 27, 2008 | (JP) | 2008-168073 |

(51) Int. Cl.
*B32B 15/01* (2006.01)
*B32B 15/04* (2006.01)

(Continued)

(52) U.S. Cl.
CPC . *C23C 30/00* (2013.01); *C25D 5/48* (2013.01); *C23C 28/021* (2013.01);

(Continued)

(58) Field of Classification Search
USPC ..... 428/600, 548, 647, 646, 648, 658, 659, 428/660, 661, 662, 671, 674, 675, 676, 677, 428/678, 679, 680, 682, 684, 685, 626, 624, 428/457, 687, 612, 615, 632, 633, 639, 640, 428/340, 341, 219, 215, 336
See application file for complete search history.

(56) References Cited

U.S. PATENT DOCUMENTS

| | | | |
|---|---|---|---|
| 4,904,545 | A | 2/1990 | Sagiyama et al. |
| 4,910,095 | A | 3/1990 | Izaki et al. |

(Continued)

FOREIGN PATENT DOCUMENTS

| | | |
|---|---|---|
| EP | 0298476 | 1/1989 |
| EP | 0323756 | 7/1989 |

(Continued)

OTHER PUBLICATIONS

Abstract, Azuma, JP 63-235464, Sep. 1988.*

(Continued)

*Primary Examiner* — Michael E La Villa
(74) *Attorney, Agent, or Firm* — Young & Thompson

(57) ABSTRACT

It is an object to provide a surface-treated steel sheet which contains no Cr, which is excellent in wet resin adhesion, and which can be used as an alternative to a conventional tin-free steel sheet and to provide a resin-coated steel sheet produced by coating the surface-treated steel sheet with resin. A surface-treated steel sheet including an adhesive layer which is disposed on at least one surface of the steel sheet and which contains Ti and at least one selected from the group consisting of Co, Fe, Ni, V, Cu, Mn, and Zn, the ratio of the total amount of Co, Fe, Ni, V, Cu, Mn, and Zn to the amount of Ti contained therein being 0.01 to ten on a mass basis, and a method for producing the surface-treated steel sheet.

14 Claims, 6 Drawing Sheets

(51) Int. Cl.

| | |
|---|---|
| ***B32B 15/18*** | (2006.01) |
| ***C25D 5/10*** | (2006.01) |
| ***C25D 5/12*** | (2006.01) |
| ***C25D 5/48*** | (2006.01) |
| ***C23C 28/02*** | (2006.01) |
| ***C23C 30/00*** | (2006.01) |
| ***C25D 7/00*** | (2006.01) |
| ***C23C 28/00*** | (2006.01) |

(52) U.S. Cl.

CPC . *C25D 7/00* (2013.01); *C23C 28/00* (2013.01); *C23C 28/023* (2013.01)

USPC ..... 428/687; 428/600; 428/647; 428/648; 428/660; 428/678; 428/684; 428/685; 428/626; 428/632; 428/633; 428/341; 428/215; 428/219; 428/336

(56) References Cited

U.S. PATENT DOCUMENTS 5,082,536 A 1/1992 Izaki et al.

2008/0063896 A1 3/2008 Fujibayashi et al.

FOREIGN PATENT DOCUMENTS

| | | | |
|---|---|---|---|
| GB | 2 150 152 A | * | 6/1985 |
| GB | 2150152 | | 6/1985 |
| JP | 63-235464 | * | 9/1988 |
| JP | 2005-105321 | | 4/2005 |
| JP | 2005-146377 | | 6/2005 |
| JP | 2007-217728 | | 8/2007 |

OTHER PUBLICATIONS

Translation, Mitsuo Higashi, JP 63-235464 A, Sep. 1988.*

International Search Report, PCT/JP2008/070255, Dec. 16, 2008.

Supplementary European Search Report dated Dec. 6, 2012 in corresponding European Patent Application No. EP 08 84 4918.

* cited by examiner

SURFACE-TREATED STEEL SHEET AND RESIN-COATED STEEL SHEET

TECHNICAL FIELD

The present invention relates to surface-treated steel sheets which are used principally for containers such as cans after being coated with resin in such a manner that resin films or the like are laminated on the surface-treated steel sheets or resin-containing paints are applied onto the surface-treated steel sheets. The present invention particularly relates to a surface-treated steel sheet having high adhesion (hereinafter referred to as wet resin adhesion) to resin applied thereto in a high-temperature humid environment, a method for producing the surface-treated steel sheet, and a resin-coated steel sheet produced by coating the surface-treated steel sheet with resin.

The present invention further relates to a surface-treated steel sheet that exhibits high corrosion resistance even if resin applied thereto is peeled therefrom, a method for producing the surface-treated steel sheet, and a resin-coated steel sheet produced by coating the surface-treated steel sheet with resin.

BACKGROUND ART

Tin-plated steel sheets and electrolytically chromated steel sheets referred to as tin-free steel sheets are used for various metal cans such as beverage cans, food cans, pail cans, and 18-litter cans. In particular, the tin-free steel sheets are produced by electrolyzing steel sheets in a plating bath containing hexavalent chromium and have the advantage of having excellent wet resin adhesion to resin such as paint.

In recent years, the use of hexavalent chromium has tended to be restricted worldwide in response to growing environmental awareness. Alternatives to the tin-free steel sheets, which are produced using such a plating bath containing hexavalent chromium, have been needed. For example, Japanese Unexamined Patent Application Publication No. 2004-285380 discloses a steel sheet, electrolyzed in a tungstic acid solution, for containers. Japanese Unexamined Patent Application Publication No. 2001-220685 discloses a surface-treated steel sheet, coated with a phosphonate layer, for containers. Japanese Unexamined Patent Application Publication No. 2002-355921 discloses a steel sheet, coated with a surface treatment layer containing one or both of Sn and Ni, for containers, the surface treatment layer being overlaid with a resin layer which contains one or both of tannic acid and acetic acid and Ti, Zn, or one or more of compounds thereof and which has a phenol structure. Japanese Unexamined Patent Application Publication No. 2006-009046 discloses a surface-treated metal material having an organic surface treatment layer and an inorganic surface treatment layer which contains no phosphate ion but principally contains T, O, and/or F.

Various types of metal cans have been conventionally manufactured in such a manner that metal sheets such as tin-free steel sheets are painted and then formed into can bodies. In recent years, the following method has been widely used to reduce the amount of industrial waste: a method in which a resin-coated metal sheet that is not painted but is coated with resin such as a resin film is formed into a can body. For the resin-coated metal sheet, the resin needs to strongly adhere to the metal sheet. In particular, resin-coated metal sheets used for beverage or food cans need to have high wet resin adhesion such that no resin is peeled therefrom even in high-temperature humid environments, because the beverage or food cans are subjected to retort sterilization steps in some cases after contents are packed in the beverage or food cans.

Furthermore, the resin-coated metal sheets need to have high corrosion resistance such that the cans are prevented from being perforated by corrosion due to the contents of the cans even if resin is partly peeled from the cans by scratching.

The following sheets and material have insufficient wet resin adhesion when being used in a retort atmosphere: the steel sheet electrolyzed in the tungstic acid solution as disclosed in Japanese Unexamined Patent Application Publication No. 2004-285380, the surface-treated steel sheet coated with the phosphonate layer as disclosed in Japanese Unexamined Patent Application Publication No. 2001-220685, the steel sheet having the resin layer having the phenol structure as disclosed in Japanese Unexamined Patent Application Publication No. 2002-355921, and the surface-treated metal material having the organic surface treatment layer and the inorganic surface treatment layer principally containing T, O, and/or F as disclosed in Japanese Unexamined Patent Application Publication No. 2006-009046.

It is an object of the present invention to provide a surface-treated steel sheet which contains no Cr, which has excellent wet resin adhesion, and which can be used as an alternative to a tin-free steel sheet; a method for producing the surface-treated steel sheet; and a resin-coated steel sheet produced by coating the surface-treated steel sheet with resin.

DISCLOSURE OF INVENTION

The scope of the present invention is as described below.

1. A surface-treated steel sheet includes an adhesive layer which is disposed on at least one surface of the steel sheet and which contains Ti and at least one selected from the group consisting of Co, Fe, Ni, V, Cu, Mn, and Zn. The ratio of the total amount of Co, Fe, Ni, V, Cu, Mn, and Zn to the amount of Ti contained therein is 0.01 to ten on a mass basis.
2. In the surface-treated steel sheet specified in Item 1, the adhesive layer has a thickness of 20 to 800 nm and also has bumps arranged with a line density of one or more per μm, the thickness of the adhesive layer is defined as the maximum height H from the lower surface of the adhesive layer to the bumps in a cross-sectional profile of the layer observed with a transmission electron microscope (TEM), and the line density of the bumps is defined as the number of the bumps per unit length. The number thereof is determined on the assumption that one of the bumps is present when one or more intersections of an upper-level horizontal line and a profile curve are present between two intersections of a lower-level horizontal line and the profile curve. The upper- and lower-level horizontal lines are ±10 nm apart from a center line located at a position given by the formula (H+L)/2, where L represents the minimum height from the lower surface of the adhesive layer to the bottom of a recessed portion.
3. In the surface-treated steel sheet specified in Item 1, the adhesive layer has a thickness of 20 to 800 nm and also has bumps arranged with an area density of 16 or more per $\mu^2$ and the area density of the bumps of the adhesive layer is defined as the number of the bumps that are 0.005 μm higher than an average line of the bumps and recessed portions. The average line is determined in such a manner that a SEM image of the layer observed with a scanning electron microscope (SEM) is three-dimensionally analyzed and filtered at a cut-off wavelength of 1.0 μm.

4. In the surface-treated steel sheet specified in Item 3, the ratio (Rq/Ra) of root-mean-square roughness (Rq) to arithmetic average roughness (Ra) is 1.3 or less. The root-mean-square roughness and the arithmetic average roughness are specified in JIS B 0601: 2201 and determined in such a manner that a cross-sectional curve is derived from three-dimensional data obtained with a SEM and then filtered at a cut-off wavelength of 1.0 μm.
5. In the surface-treated steel sheet specified in Item 3 or 4, skewness (Rsk) is 0.6 or less or kurtosis (Rku) is four or less. The skewness and the kurtosis are specified in JIS B 0601: 2201 and determined in such a manner that a cross-sectional curve is derived from three-dimensional data obtained with a SEM and then filtered at a cut-off wavelength of 1.0 μm.
6. A surface-treated steel sheet includes an adhesive layer which is disposed on at least one surface of the steel sheet, which has a thickness of 20 to 800 nm, which contains Ti, and which has bumps arranged with a line density of one or more per μm. The thickness of the adhesive layer is defined as the maximum height H from the lower surface of the adhesive layer to the bumps in a cross-sectional profile of the layer observed with a transmission electron microscope (TEM). The line density of the bumps is defined as the number of the bumps per unit length. The number thereof is determined on the assumption that one of the bumps is present when one or more intersections of an upper-level horizontal line and a profile curve are present between two intersections of a lower-level horizontal line and the profile curve. The upper- and lower-level horizontal lines are ±10 nm apart from a center line located at a position given by the formula (H+L)/2, where L represents the minimum height from the lower surface of the adhesive layer to the bottom of a recessed portion.
7. A surface-treated steel sheet includes an adhesive layer which is disposed on at least one surface of the steel sheet, which has a thickness of 20 to 800 nm, which contains Ti, and which has bumps arranged with an area density of 16 or more per $\mu m^2$. The area density of the bumps of the adhesive layer is defined as the number of the bumps that are 0.005 μm higher than an average line of the bumps and recessed portions. The average line is determined in such a manner that a SEM image of the layer observed with a scanning electron microscope (SEM) is three-dimensionally analyzed and filtered at a cut-off wavelength of 1.0 μm.
8. In the surface-treated steel sheet specified in Item 7, the ratio (Rq/Ra) of root-mean-square roughness (Rq) to arithmetic average roughness (Ra) is 1.3 or less. The root-mean-square roughness and the arithmetic average roughness are specified in JIS B 0601: 2201 and determined in such a manner that a cross-sectional curve is derived from three-dimensional data obtained with a SEM and then filtered at a cut-off wavelength of 1.0 μm.
9. In the surface-treated steel sheet specified in Item 7 or B, skewness (Rsk) is 0.6 or less or kurtosis (Rku) is four or less. The skewness and the kurtosis are specified in JIS B 0601: 2201 and determined in such a manner that a cross-sectional curve is derived from three-dimensional data obtained with a SEM and then filtered at a cut-off wavelength of 1.0 μm.
10. In the surface-treated steel sheet specified in any one of Items 1 to 9, the amount of Ti in the adhesive layer is 3 to 200 $mg/m^2$ per one surface.
11. The surface-treated steel sheet specified in any one of Items 1 to 10 further includes a corrosion-resistant layer which is disposed on at least one surface of the steel sheet; which includes at least one selected from the group consisting of a Ni layer, a Sn layer, a Fe—Ni alloy layer, a Fe—Sn alloy layer, and a Fe—Ni—Sn alloy layer; and which is disposed under the adhesive layer.
12. The surface-treated steel sheet specified in any one of Items 1 to 11 is coated with resin.
13. A method for producing a surface-treated steel sheet includes forming a corrosion-resistant layer, including at least one selected from the group consisting of a Ni layer, a Sn layer, a Fe—Ni alloy layer, a Fe—Sn alloy layer, and a Fe—Ni—Sn alloy layer, on at least one surface of a steel sheet and also includes forming an adhesive layer in such a manner that the resulting steel sheet is cathodically electrolyzed in an aqueous solution containing ions of Ti and ions of at least one selected from the group consisting of Co, Fe, Ni, V, Cu, Mn, and Zn.
14. In the surface-treated steel sheet-producing method specified in Item 13, the content of Ti in the aqueous solution is 0.008 to 0.07 mol/l and the molar ratio of at least one selected from the group consisting of Co, Fe, Ni, V, Cu, Mn, and Zn to Ti in the aqueous solution is 0.01 to 10.
15. In the surface-treated steel sheet-producing method specified in Item 13 or 14, the amount of Ti in the adhesive layer is 3 to 200 $mg/m^2$ per one surface.

Figure 1A:
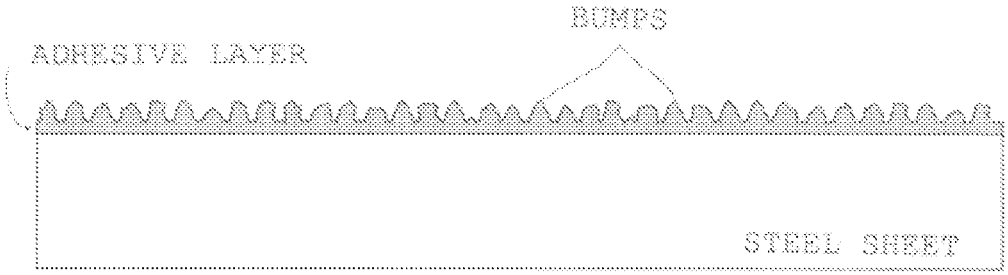
FIGS. 1A and 1B are schematic sectional views of adhesive layers included in surface-treated steel sheets according to the present invention.

| [Reference Numerals] | |
|---|---|
| 1 | steel sheet |
| 2 | film |
| 3 | notched portion of steel sheet |
| 4 | weight |
| 5 | peeled length |

BEST MODES FOR CARRYING OUT THE INVENTION

The inventors have conducted intensive research on surface-treated steel sheets which contain no Cr, which have excellent wet resin adhesion, and which can be used as alternatives to tin-free steel sheets and have then obtained findings below.

(1) Extremely excellent wet resin adhesion can be achieved by forming an adhesive layer containing Ti and an element such as Co, Fe, Ni, V, Cu, Mn, or Zn on a steel sheet.

(2) In order to achieve extremely excellent wet resin adhesion, an adhesive layer having a large number of fine bumps arranged uniformly is preferably formed.

The present invention has been made on the basis of these findings. The contents of the present invention will now be described in detail.

(1) Surface-Treated Steel Sheet

A surface-treated steel sheet according to the present invention includes an adhesive layer which is disposed on at least one surface of the surface-treated steel sheet and which contains Ti and at least one selected from the group consisting of Co, Fe, Ni, V, Cu, Mn, and Zn.

An ordinary steel sheet, such as a low-carbon steel sheet or an ultra-low-carbon steel sheet, for cans can be used as a raw steel sheet.

A steel sheet coated with an adhesive layer containing Ti or an adhesive layer which contains Ti and at least one selected from the group consisting of Co, Fe, Ni, V, Cu, Mn, and Zn has excellent wet resin adhesion.

The reason for this is unclear at present and is probably that a strong intermolecular force is present between resin and a layer which is composed of an oxide of Ti and which has high molecular weight or that the above metal element is taken in the layer containing Ti and therefore the layer has surface irregularities which are densely and uniformly distributed.

The ratio of the total amount of Co, Fe, Ni, V, Cu, Mn, and Zn to the amount of Ti in the adhesive layer needs to be 0.01 to ten on a mass basis. This allows the adhesive layer to have surface irregularities which are densely and uniformly distributed, thereby achieving excellent wet resin adhesion. The mass ratio thereof is preferably 0.1 to two. The content of the metal elements in the adhesive layer can be determined by energy-dispersive x-ray analysis (EDX) or electron energy loss spectroscopy (EELS) in TEM observation below.

In view of an increase in wet resin adhesion, the adhesive layer preferably further contains O. The presence of O probably allows the adhesive layer to be composed of an oxide of Ti to generate a strong intermolecular force between the adhesive layer and resin.

The amount of Ti in the adhesive layer is preferably 3 to 200 $mg/m^2$ per one surface. When the Ti amount is 3 $mg/m^2$ or more and 200 $mg/m^2$ or less, the effect of improving wet resin adhesion is sufficiently obtained. When the Ti amount is greater than 200 $mg/m^2$, a further improvement of wet resin adhesion is not obtained and high cost arises. The amount of Ti in the adhesive layer can be determined by X-ray fluorescence surface analysis. The amount of O therein is not particularly limited and the presence of O can be confirmed by surface analysis using an XPS (X-ray photoelectron spectrometer).

In order to achieve more excellent wet resin adhesion, the adhesive layer preferably has a thickness of 20 to 800 nm and also has bumps arranged with a line density of one or more per μm. When the thickness thereof is 20 nm or more, more excellent wet resin adhesion is achieved. When the thickness thereof is 800 nm or less, the adhesive layer is not fragile and has excellent wet resin adhesion.

Figure 1B:
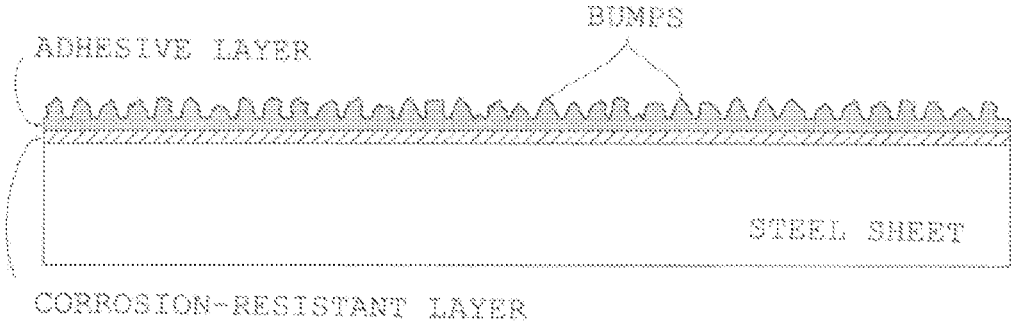
Figure 2A:
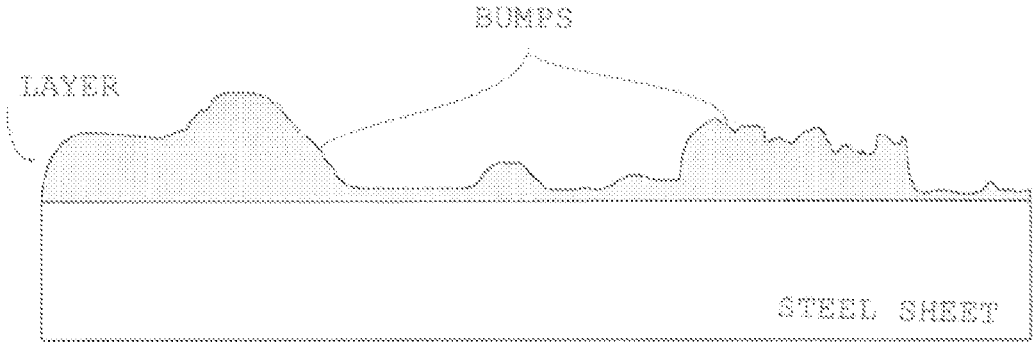
FIGS. 2A and 2B are schematic sectional views of adhesive layers included in surface-treated steel sheets of comparative examples.
Figure 2B:
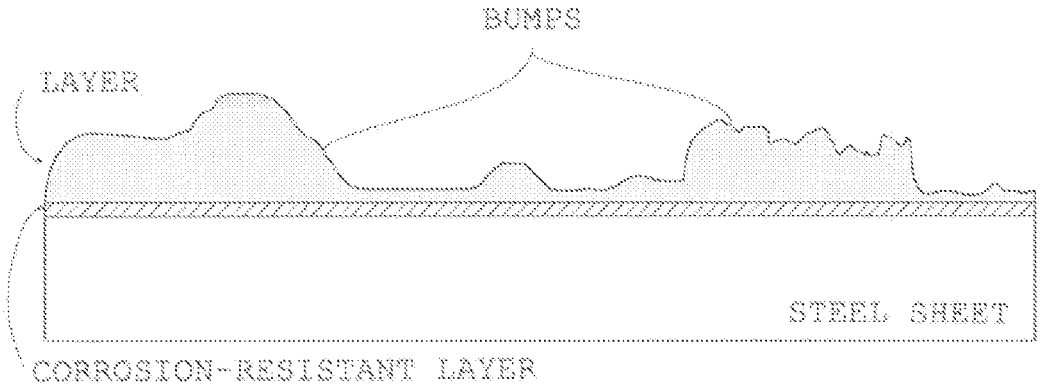

The reason why the presence of the bumps, arranged with a line density of one or more per μm, in the adhesive layer leads to an increase in wet resin adhesion is probably as described below. FIGS. 1A and 1B each schematically show an adhesive layer, in cross section, included in a surface-treated steel sheet according to a preferred embodiment of the present invention. The adhesive layer has bumps which are uniformly and densely arranged. In particular, the bumps are arranged with a line density of one or more per μm; hence, the adhesive layer has an increased surface area and an increased contact area with resin as compared to layers, included in surface-treated steel sheets schematically shown in FIGS. 2A and 2B, having nonuniform, sparse bumps. The presence of the bumps uniformly and densely arranged leads to an increase in an anchoring effect. Therefore, extremely excellent wet resin adhesion is achieved. When the line density of the bumps is less than one per μm, the contact area with resin is small and the anchoring effect is insufficient. Therefore, the above effect is not exhibited and the effect of increasing wet resin adhesion is small.

Figure 3A:
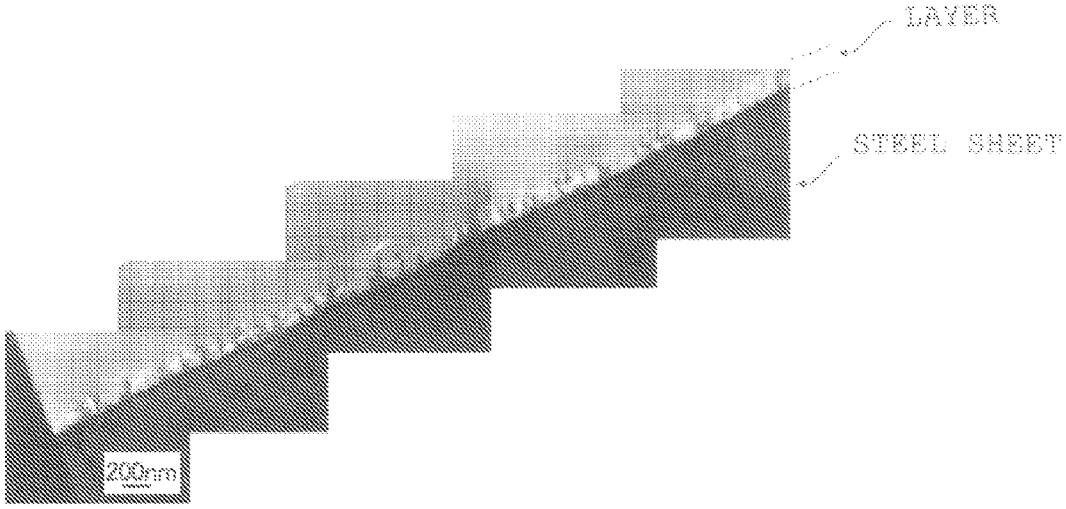
FIGS. 3A and 3B are images illustrating the TEM observation results of a cross-sectional surface of an adhesive layer of an example of the present invention and a cross-sectional surface of a layer of a comparative example.
Figure 3B:
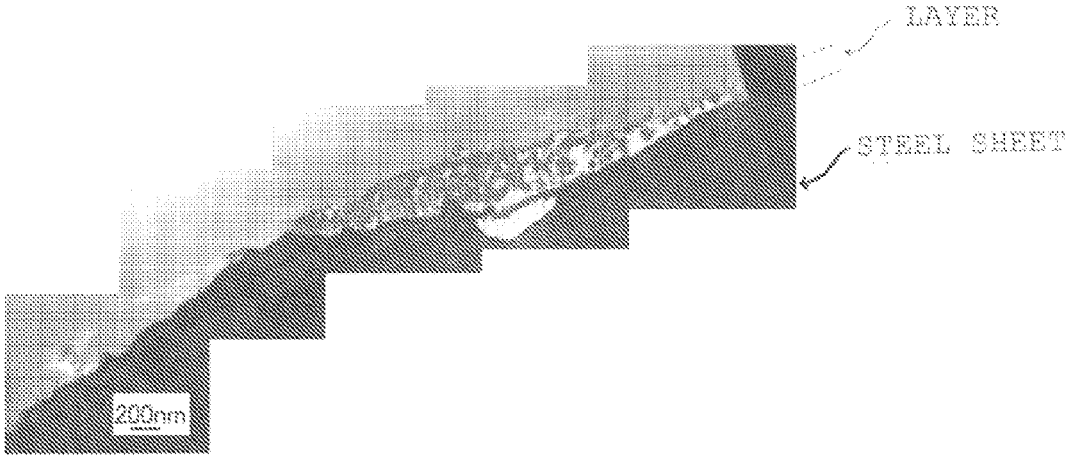

FIGS. 3A and 3B show results obtained by observing thin-film samples with a TEM (transmission electron microscope), the thin-film samples being prepared by processing a cross-sectional surface of a surface-treated steel sheet of an example (No. 8 of an example below) and a cross-sectional surface of a surface-treated steel sheet of a comparative example (No. 1 of a comparative example below) by a focused ion beam (FIB) process. The sample shown in FIG. 3A has a layer having bumps which are more uniformly and densely arranged as compared to those shown in FIG. 3B.

The thickness of an adhesive layer and the line density of bumps of the adhesive layer are defined on the basis of a cross-sectional profile of the adhesive layer, observed with a TEM, shown in FIG. 3A or 3B as described below. Any cross-sectional profile of the adhesive layer observed in an arbitrary in-plane direction of the adhesive layer can be used herein.

Figure 4:
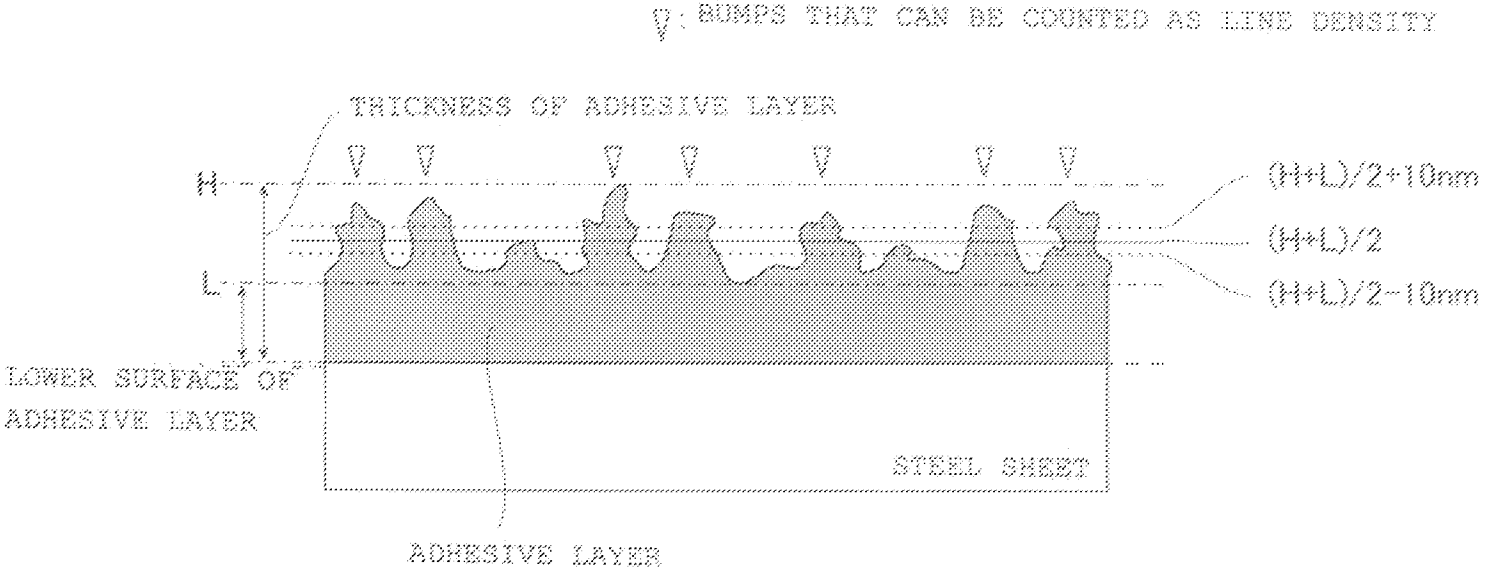
FIG. 4 is a schematic view illustrating the thickness of an adhesive layer included in a surface-treated steel sheet according to the present invention and the line density of bumps of the adhesive layer.

FIG. 4 is a schematic view illustrating the thickness of an adhesive layer of a surface-treated steel sheet according to the present invention and the line density of bumps of the adhesive layer. The thickness of the adhesive layer is defined as the maximum height H from the lower surface of the adhesive layer to the bumps in a cross-sectional profile of the layer observed with a TEM. The line density of the bumps is defined as the number of the bumps per unit length, the number thereof being determined on the assumption that one of the bumps is present when one or more intersections of an upper-level horizontal line and a profile curve are present between two intersections of a lower-level horizontal line and the profile curve, the upper- and lower-level horizontal lines being ±10 nm apart from a center line located at a position given by the formula (H+L)/2, wherein L represents the minimum height from the lower surface of the adhesive layer to the bottom of one of recessed portions.

The thickness of the adhesive layer may be determined in such a manner that the highest protruding portion is selected from the TEM cross-sectional profile of the layer and the height from the lower surface of the layer is measured. The minimum height L from the lower surface of the adhesive layer to the bottom of one of the recessed portions may be determined in such a manner that the deepest recessed portion is selected from the cross-sectional profile of the layer and the height from the lower surface of the layer to the bottom of the deepest recessed portion is measured.

Figure 5A:
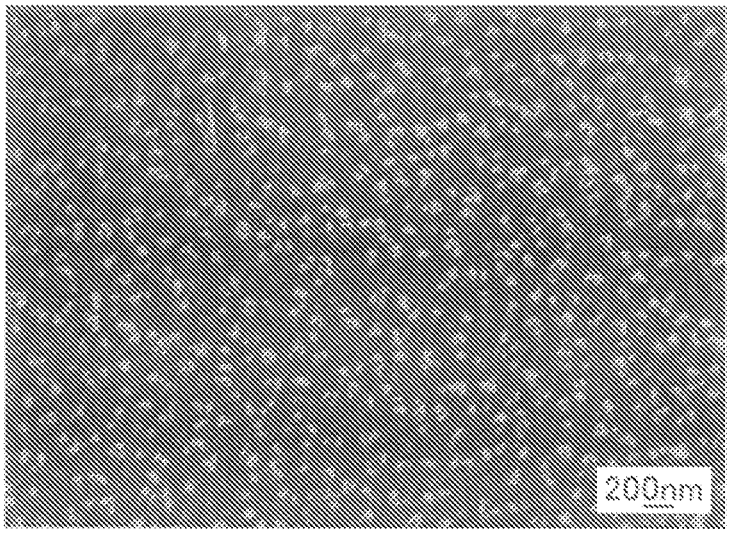
FIGS. 5A and 5B are images illustrating the SEM observation results of an adhesive layer of an example of the present invention and a layer of a comparative example.
Figure 5B:
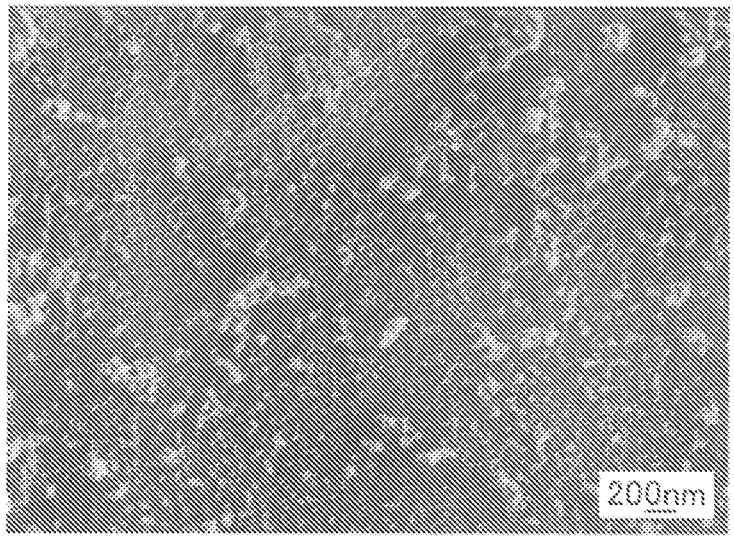

In the present invention, the distribution of bumps present in an adhesive layer can be defined as an area density of 16 or more per $\mu m^2$ in such a manner that a surface image of the adhesive layer observed with a SEM is three-dimensionally analyzed. FIGS. 5A and 5B show a SEM image of an example (No. 8 of an example below) of the present invention and a SEM image of a comparative example (No. 1 of a comparative example below), respectively. The example shown in FIG. 5A has a layer having bumps which are more uniformly and densely arranged as compared to those of the comparative example shown in FIG. 5B. The presence of the uniformly and densely arranged bumps leads to an increase in surface area, an increase in contact area with resin, and an increase in anchoring effect due to the recessed and bumps as described above; hence, extremely excellent wet resin adhesion is probably achieved.

The area density of the bumps in the adhesive layer can be determined to be the number of the bumps that are 0.005 μm higher than an average line of the recessed and bumps that is determined in such a manner that the SEM image (a 6 μm×4.5 μm region) shown in FIG. 5A or 5B is three-dimensionally analyzed and swells are eliminated by filtering at a cut-off wavelength of 1.0 μm.

For the density of the bumps in the adhesive layer, the line density determined from the cross-sectional profile of the TEM cross-sectional profile of the layer and the area density determined by three-dimensionally analyzing the SEM surface image of the layer are separately specified above. The reason for this is that the former has a problem that it takes a long time to prepare or measure a sample although the adhesive layer can be directly observed and the latter is simple and speedy in measurement although it takes a long time to remove a resin layer when the resin layer is present on the layer. According to the present invention, it has been confirmed that the wet resin adhesion defined by the line density is equivalent to that defined by the area density.

The ratio (Rq/Ra) of Rq to Ra is preferably 1.3 or less because the distribution of the bumps is uniform and dense, Rq and Ra being specified in JIS B 0601: 2201 and being determined in such a manner that a cross-sectional curve is derived from three-dimensional data obtained with a SEM and then filtered at a cut-off wavelength of 1.0 μm. Furthermore, Rsk or Rku is preferably 0.6 or less or four or less, respectively, because the adhesive layer has a large surface area when being coated with resin, endures a pressure for forming a rigid interface, and exhibits an anchoring effect, Rsk and Rku being specified in JIS B 0601: 2201 and being determined in such a manner that a cross-sectional curve is derived from three-dimensional data obtained with a SEM and then filtered at a cut-off wavelength of 1.0 μm.

A process for forming the adhesive layer is preferably as follows: a steel sheet coated with a corrosion-resistant layer is cathodically electrolyzed or immersed in an aqueous solution containing Ti and ions of at least one selected from the group consisting of Co, Fe, Ni, V, Cu, Mn, and Zn. Preferred examples of an aqueous solution containing Ti include aqueous solutions containing fluorotitanate ions and aqueous solutions containing fluorotitanate ions and fluorides. Examples of compounds producing fluorotitanate ions include fluorotitanic acid, ammonium fluorotitanate, and potassium fluorotitanate. Examples of the fluorides include sodium fluoride, potassium fluoride, silver fluoride, and tin fluoride. In particular, the steel sheet coated with the corrosion-resistant layer is preferably cathodically electrolyzed in an aqueous solution containing potassium fluorotitanate or an aqueous solution containing potassium fluorotitanate and sodium fluoride, because the adhesive layer can be uniformly formed with high efficiency.

Examples of compounds producing ions of Co, Fe, Ni, V, Cu, Mn, or Zn include cobalt sulfate, cobalt chloride, iron sulfate, iron chloride, nickel sulfate, copper sulfate, vanadium oxysulfate, zinc sulfate, and manganese sulfate.

The mass ratio of the metal ions to the Ti ions in the aqueous solution may be adjusted such that the mass ratio of the metal elements to Ti in the adhesive layer is 0.01 to ten. The current density and electrolysis time of cathodic electrolysis or the time of immersion may be appropriately determined depending on the necessary amount of Ti. The content of the metal elements in the layer can be measured by energy-dispersive x-ray analysis (EDX) or electron energy loss spectroscopy (EELS) in TEM observation as described above.

The corrosion-resistant layer includes at least one selected from the group consisting of a Ni layer, a Sn layer, a Fe—Ni alloy layer, a Fe—Sn alloy layer, and a Fe—Ni—Sn alloy layer. After the corrosion-resistant layer is formed on at least one surface of the steel sheet, the adhesive layer is formed on the corrosion-resistant layer. This allows the surface-treated steel sheet to have increased corrosion resistance.

The corrosion-resistant layer, which is disposed on the steel sheet, needs to include the Ni layer, the Sn layer, the Fe—Ni alloy layer, the Fe—Sn alloy layer, the Fe—Ni—Sn alloy layer, or some of these layers so as to be tightly bonded to the steel sheet and so as to allow the steel sheet to have excellent corrosion resistance even if resin is partly peeled from the steel sheet by scratching or the like.

The corrosion-resistant layer can be formed by a known process depending on a metal element contained therein.

(2) Resin-Coated Steel Sheet (Laminated Steel Sheet)

A resin-coated steel sheet can be produced by coating the surface-treated steel sheet according to the present invention with resin. The surface-treated steel sheet according to the present invention has excellent wet resin adhesion as described above; hence, the resin-coated steel sheet has excellent corrosion resistance and work-ability.

The resin used to coat the surface-treated steel sheet according to the present invention is not particularly limited and may be a resin film for lamination or a resin paint for painting. Examples of the resin include various thermoplastic resins and thermosetting resins. Examples of the resin film for lamination include olefin resin films made of polyethylene, polypropylene, ethylene-propylene copolymers, ethylene-vinyl acetate copolymers, ethylene-acrylic ester copolymers, ionomers, or the like; polyester films made of polybutylene terephthalate or the like; polyamide films made of nylon 6, nylon 66, nylon 11, nylon 12, or the like; and thermoplastic resin films such as polyvinyl chloride films and polyvinylidene chloride films. These films may be unstretched or biaxially stretched. Preferred examples of an adhesive used for lamination (laminate) include urethane adhesives, epoxy adhesives, acid-modified olefin resin adhesives, copolyamide adhesives, and copolyester adhesives (a thickness of 0.1 to 5.0 μm). A thermosetting lacquer may be applied onto the surface-treated steel sheet or the film so as to form a layer with a thickness of 0.05 to 2 μm.

Examples of the lacquering include thermoplastic and thermosetting paints such as modified epoxy paints including phenol epoxy paints and amino-epoxy paints; vinyl chloride-vinyl acetate copolymers; saponified vinyl chloride-vinyl acetate copolymers; vinyl chloride-vinyl acetate-maleic anhydride copolymers; vinyl paints; modified vinyl paints including epoxy-modified vinyl paints, epoxy amino-modified vinyl paints, and epoxy phenol-modified vinyl paints; acrylic paints; and synthetic rubber paints including styrene-butadiene copolymers. These lacquers may be used alone or in combination.

In the present invention, a resin layer preferably has a thickness of 3 to 50 μm and more preferably 5 to 40 μm. When the thickness thereof is less than the above range, the corrosion resistance thereof is insufficient. When the thickness thereof is greater than the above range, a work-ability problem is likely to occur.

In the present invention, the resin layer can be formed on or above the surface-treated steel sheet by an arbitrary process. When the surface-treated steel sheet is coated with resin by lamination, the following process can be used: for example, an extrusion-coating process, a cast film heat-bonding process, or a biaxially stretched film heat-bonding process. For the extrusion-coating process, the surface-treated steel sheet may be extrusion-coated with molten resin, which is then heat-bonded thereto. That is, resin is melted and kneaded in an extruder and then extruded into a thin film from a T-die, the extruded molten thin film is fed between a pair of lamination rollers together with the surface-treated steel sheet, and the thin film and the surface-treated steel sheet are pressed against each other under cooling conditions so as to be unified and are then quenched. In the case where a multilayer resin coating is formed by extrusion coating, a plurality of extruders for sub-layers are used and flows of resins are discharged from the extruders, are joined in a multilayer die, and may then be subjected to extrusion coating in the same manner as that used for a single-layer resin. Alternatively, the surface-treated steel sheet is fed perpendicularly to a pair of lamination rollers and a molten resin web is supplied to both sides thereof, whereby resin coating layers can be formed on both surfaces of the surface-treated steel sheet.

The resin-coated steel sheet produced as described above can be used for three-piece cans with side seams and seamless cans (two-piece cans). The resin-coated steel sheet can be used for lids of stay-on-tab type easy-open cans and lids of full open type easy-open cans.

Described above are merely examples of embodiments of the present invention. Various modifications may be made within the scopes of the claims.

(3) Method for Producing Surface-Treated Steel Sheet

A producing method according to the present invention is as described below: a corrosion-resistant layer including at least one selected from the group consisting of a Ni layer, a Sn layer, a Fe—Ni alloy layer, a Fe—Sn alloy layer, and a Fe—Ni—Sn alloy layer is formed on at least one side of a steel sheet and an adhesive layer is formed on the corrosion-resistant layer in such a manner that the steel sheet is cathodically electrolyzed in an aqueous solution containing ions of Ti and ions of at least one selected from the group consisting of Co, Fe, Ni, V, Cu, Mn, and Zn.

The adhesive layer can be formed in such a manner that the steel sheet is cathodically electrolyzed in the aqueous solution, which contains the Ti ions and the ions of at least one selected from the group consisting of Co, Fe, Ni, V, Cu, Mn, and Zn. The content of Ti in the aqueous solution is preferably 0.008 to 0.07 mol/l and more preferably 0.02 to 0.05 mol/l. The molar ratio of at least one selected from the group consisting of Co, Fe, Ni, V, Cu, Mn, and Zn to Ti in the aqueous solution is preferably 0.01 to 10 and more preferably 0.1 to 2.5, because the adhesive layer can be formed so as to have surface irregularities densely and uniformly distributed and excellent wet resin adhesion is achieved.

Preferred examples of an aqueous solution containing Ti include aqueous solutions containing fluorotitanate ions and aqueous solutions containing fluorotitanate ions and fluorides. Examples of compounds producing the fluorotitanate ions include fluorotitanic acid, ammonium fluorotitanate, and potassium fluorotitanate. Examples of the fluorides include sodium fluoride, potassium fluoride, silver fluoride, and tin fluoride. In particular, the steel sheet coated with the corrosion-resistant layer is preferably cathodically electrolyzed in an aqueous solution containing potassium fluorotitanate or an aqueous solution containing potassium fluorotitanate and sodium fluoride, because the layer can be uniformly formed with high efficiency.

Examples of compounds producing ions of Co, Fe, Ni, V, Cu, Mn, or Zn include cobalt sulfate, cobalt chloride, iron sulfate, iron chloride, nickel sulfate, copper sulfate, vanadium oxysulfate, zinc sulfate, and manganese sulfate.

In order to allow the content of Ti in the aqueous solution to be 0.008 to 0.07 mol/l and preferably 0.02 to 0.05 mol/1 and in order to allow the molar ratio of at least one selected from the group consisting of Co, Fe, Ni, V, Cu, Mn, and Zn to Ti to be 0.01 to 10 and preferably 0.1 to 2.5, the mass ratio of Ti to at least one of these metals in the aqueous solution may be adjusted. In cathodic electrolysis, the current density and the electrolysis time are preferably 5 to 20 A/dm$^2$ and 2 to 10 sec, respectively.

EXAMPLES

Corrosion-resistant layers are formed on both surfaces of each cold-rolled low-carbon steel sheet (a thickness of 0.2 mm) used to produce a tin-free steel sheet by one of Processes A to D below in Plating Bath a or b shown in FIG. 1 (Nos. 30 and 31 are excluded).

A: A cold-rolled steel sheet is annealed at about 700° C., temper-rolled at an elongation rate of 1.5%, degreased by alkali electrolysis, pickled with sulfuric acid, and then plated with Ni in Plating Bath a, whereby corrosion-resistant layers including Ni layers are formed.

B: A cold-rolled steel sheet is degreased by alkali electrolysis, plated with Ni in Plating Bath a, annealed at about 700° C. in an atmosphere containing ten volume percent $H_2$ and 90 volume percent $N_2$ such that Ni platings diffuse to permeate the steel sheet, and then temper-rolled at an elongation rate of 1.5%, whereby corrosion-resistant layers including Fe—Ni alloy layers are formed.

C: A cold-rolled steel sheet is degreased by alkali electrolysis, plated with Ni in Plating Bath a, annealed at about 700° C. in an atmosphere containing ten volume percent $H_2$ and 90 volume percent $N_2$ such that Ni platings diffuse to permeate the steel sheet, temper-rolled at an elongation rate of 1.5%, degreased, pickled, plated with Sn in Plating Bath b, and then subjected to heat melting by heating the steel sheet to a temperature higher than the melting point of tin. This process allows corrosion-resistant layers including Fe—Ni—Sn alloy layers and Sn layers disposed thereon to be formed.

D: A cold-rolled steel sheet is degreased by alkali electrolysis, annealed under the same conditions as Conditions A, temper-rolled under the same conditions as Conditions A, plated with Sn in Plating Bath b, and then subjected to heat melting by heating the steel sheet to a temperature higher than the melting point of tin. This process allows corrosion-resistant layers including Fe—Sn alloy layers and Sn layers disposed thereon to be formed.

In Processes C and D, the Sn platings are partly alloyed. The net amount of Sn remaining without being alloyed is shown in Tables 3 and 4 together with the amount of Ni and the amount of Sn in each corrosion-resistant layer.

The corrosion-resistant layers formed on both surfaces of each steel sheet are cathodically electrolyzed under conditions shown in Tables 2 to 4 and then dried such that adhesive layers are formed on the corrosion-resistant layers, whereby Surface-treated Steel Sheet Nos. 1 to 31 shown in Tables 2 to 4 are prepared. The adhesive layers of Surface-treated Steel Sheet Nos. 1, 16, 19, 22, and 29 contain none of Co, Fe, Ni, V, Cu, Mn, and Zn and therefore these sheets are comparative examples.

The amount of Ti in each adhesive layers is determined by X-ray fluorescence spectrometry in comparison with a calibration sheet in which the amount of each deposited metal is determined by chemical analysis in advance. The amount of deposited Co, Fe, Ni, V, Cu, Mn, and Zn is determined by a technique selected from the group consisting of the same X-ray fluorescence spectrometry as that used to determine the amount of Ti, chemical analysis, Auger electron spectroscopy, and secondary ion mass spectrometry. The mass ratio of Co, Fe, Ni, V, Cu, Mn, and Zn to that of Ti in the adhesive layer is then evaluated. The presence of O in each of Surface-treated Steel Sheet Nos. 1 to 31 can be confirmed by XPS surface analysis.

For some of the surface-treated steel sheets, the thickness of each adhesive layer and the line density of bumps are measured in such a manner that a thin film sample is prepared by processing a cross-sectional surface of the layer using an FIB and a cross-sectional profile of the sample is observed with a TEM. In this operation, an evaluation region of the sample is determined by SEM observation in advance, a protective layer is formed thereon, and the thin film sample is prepared by processing the cross-sectional surface using the FIB and Ga ions so as to have a thickness of about 0.1 μm and is then observed with the TEM. In the present invention, the FIB is obtained with SMI-3050 MS2 manufactured by SII-NT and the TEM is JEM-2010F manufactured by JOEL Ltd.

A SEM image is obtained with a SEM that can measure the shape of irregularities. In the present invention, a high-resolution SEM, ERA-8800FE, manufactured by Elionix Inc. is used. This instrument includes four secondary electron detectors and can display an image in which a difference in composition is emphasized or an image which shows irregularities viewed in a specific direction from sum signals and/or difference signals of secondary electrons. The adhesive layers of some of the surface-treated steel sheets are calculated for Rq, Ra, Rsk, and Rku on the basis of obtained SEM images using an image-processing program attached to this instrument. The area density of bumps is calculated in such a manner that the SEM image obtained with the SEM is analyzed using a three-dimensional surface analyzing program, "SUMMIT", developed by Yanagi laboratory in Nagaoka University of Technology. Au is vapor-deposited on each sample to a thickness of about 10 nm in advance of observation. The resulting sample is observed with the SEM at a magnification of 20000 times and an acceleration voltage of 5 kV. The sample is analyzed in arbitrary five fields of view and the obtained data is averaged, whereby the area density of the bumps and the like are determined. For the calculation of Rq, Ra, Rsk, and Rku, 100 or more cross-sectional curves are taken in each field of view and evaluation values are obtained by averaging values determined by evaluating roughness curves extracted from the cross-sectional curves and then averaged in five fields of view.

Figure 6C:
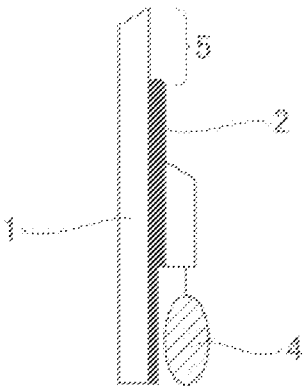
FIGS. 6A, 6B, and 6C are illustrations showing a 180° peeling test.
Figure 6B:
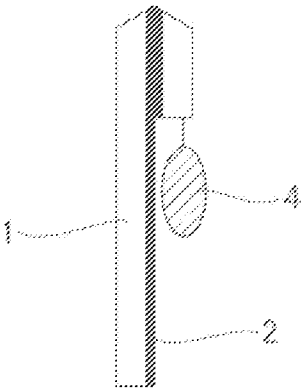
Figure 6A:
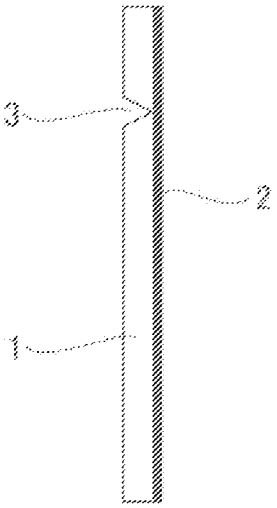

Films which are made of polyethylene terephthalate copolymerized with isophthalic acid and which have the following properties are prepared: a draw ratio of 3.1×3.1, a thickness of 25 μm, a copolymerization ratio of 12 mole percent, and a melting point of 224° C. The films are laminated on both surfaces of each of Surface-treated Steel Sheet Nos. 1 to 31 such that the degree of biaxial orientation (BO value) of the films is 150 under the following lamination conditions: a steel sheet feed rate of 40 m/min, a nip length of 17 mm, and a time lag between pressing and water cooling of one second. This allows Laminated Steel Sheet Nos. 1 to 31 to be prepared. The term "nip length" means the length of a contact portion of a rubber roller with each steel sheet in the feed direction of the steel sheet. Laminated Steel Sheet Nos. 1 to 31 are evaluated for wet resin adhesion as described below. Wet resin adhesion: Humid resin adhesion is evaluated by a 180° peeling test in a retort atmosphere having a temperature of 130° C. and a relative humidity of 100%. The 180° peeling test is a film-stripping test in which a test piece (a size of 30 mm×100 mm, the front and rear surfaces being each n=1, each laminated steel sheet being n=2) that includes a steel sheet 1 having a notched portion 3 and a film 2 attached thereto as shown in FIG. 6A is used, a weight 4 (100 g) is attached to an end of the test piece, and the test piece is folded 180° over the film 2 as shown in FIG. 6B and then left for 30 minutes. A strip length 5 shown in FIG. 6C is measured and then evaluated. The strip lengths (n=2) of the front and rear surfaces of each laminated steel sheet are averaged. The smaller the strip length 5, the better the wet resin adhesion. When the strip length 5 is less than 10 mm, the test piece is evaluated to be excellent in wet resin adhesion as targeted in the present invention.

The evaluation results are shown in Tables 5 and 6. Laminated Steel Sheet Nos. 2 to 15, 17, 18, 20, 21, and 23 to 28, which are examples of the present invention, have excellent wet resin adhesion. In contrast, Laminated Steel Sheet Nos. 1, 16, 19, 22, and 29, which are comparative examples, have poor wet resin adhesion.

TABLE 1

| Plating baths | Bath compositions |
|---|---|
| a (Ni plating bath) | 250 g/l nickel sulfate, 45 g/l nickel chloride, and 30 g/l boric acid |
| b (Sn plating bath) | 55 g/l stannous sulfate, 35 g/l phenolsulfonic acid (65 mass percent), and an appropriate amount of a brightener |

TABLE 2

| Surface-treated Steel Sheet Nos. | Plating Processes | Cathodic electrolysis: Bath compositions | Contents of Ti in plating baths (mol/l) | Molar ratios of metal M to Ti in plating baths | Current density (A/dm$^2$) | Electrolysis time (sec) | Corrosion-resistant coatings Amounts of Ni and Si in coatings (mg/m$^2$): Ni | Sn | Adhesive coatings: Amount of Ti (mg/m$^2$) | Added elements | Mass ratio M/Ti | Thickness (nm) | Remarks |
|---|---|---|---|---|---|---|---|---|---|---|---|---|---|
| 1 | A | 10.6 g/l potassium fluorotitanate | 0.044 | 0 | 6 | 2 | 290 | 0 | 60 | Not used | 0 | 70 | Comparative example |

TABLE 2-continued

| Surface-treated Steel Sheet Nos. | Plating Processes | Cathodic electrolysis: Bath compositions | Contents of Ti in plating baths (mol/l) | Molar ratios of metal M to Ti in plating baths | Current density (A/dm$^2$) | Electrolysis time (sec) | Corrosion-resistant coatings Amounts of Ni and Si in coatings (mg/m$^2$): Ni | Sn | Adhesive coatings: Amount of Ti (mg/m$^2$) | Added elements | Mass ratio M/Ti | Thickness (nm) | Remarks |
|---|---|---|---|---|---|---|---|---|---|---|---|---|---|
| 2 | A | 10.6 g/l potassium fluorotitanate and 5 g/l cobalt chloride hexahydrate | 0.044 | 0.48 | 5 | 2 | 295 | 0 | 20 | Co | 0.10 | 80 | Example |
| 3 | A | 10.6 g/l potassium fluorotitanate and 15 g/l cobalt chloride hexahydrate | 0.044 | 1.43 | 6 | 2 | 295 | 0 | 60 | Co | 1.2 | 200 | Example |
| 4 | A | 10.6 g/l potassium fluorotitanate and 15 g/l cobalt chloride hexahydrate | 0.044 | 1.43 | 7 | 2 | 295 | 0 | 100 | Co | 1.3 | 300 | Example |
| 5 | A | 10.6 g/l potassium fluorotitanate and 5 g/l cobalt sulfate heptahydrate | 0.044 | 0.40 | 7 | 2 | 295 | 0 | 60 | Co | 0.10 | 180 | Example |
| 6 | A | 10.6 g/l potassium fluorotitanate and 5 g/l cobalt sulfate heptahydrate | 0.044 | 0.40 | 8 | 2 | 295 | 0 | 100 | Co | 0.10 | 300 | Example |
| 7 | A | 10.6 g/l potassium fluorotitanate, 5 g/l iron sulfate heptahydrate, and 10 g/l cobalt chloride hexahydrate | 0.044 | 1.36 | 6 | 2 | 295 | 0 | 20 | Fe and Co | 1.2 | 90 | Example |
| 8 | A | 10.6 g/l potassium fluorotitanate and 5 g/l iron sulfate heptahydrate | 0.044 | 0.41 | 7 | 2 | 295 | 0 | 60 | Fe | 0.11 | 200 | Example |
| 9 | A | 10.6 g/l potassium fluorotitanate and 5 g/l iron sulfate heptahydrate | 0.044 | 0.41 | 6 | 2 | 295 | 0 | 20 | Fe | 0.10 | 90 | Example |
| 10 | A | 10.6 g/l potassium fluorotitanate and 5 g/l copper sulfate pentahydrate | 0.044 | 0.40 | 6 | 2 | 300 | 0 | 20 | Cu | 0.1 | 70 | Example |
| 11 | A | 10.6 g/l potassium | 0.044 | 0.72 | 6 | 2 | 295 | 0 | 20 | V | 0.15 | 80 | Example |

TABLE 2-continued

| Surface-treated Steel Sheet Nos. | Plating Processes | Cathodic electrolysis: Bath compositions | Contents of Ti in plating baths (mol/l) | Molar ratios of metal M to Ti in plating baths | Current density (A/dm$^2$) | Electrolysis time (sec) | Corrosion-resistant coatings Amounts of Ni and Si in coatings (mg/m$^2$): Ni | Sn | Adhesive coatings: Amount of Ti (mg/m$^2$) | Added elements | Mass ratio M/Ti | Thickness (nm) | Remarks |
|---|---|---|---|---|---|---|---|---|---|---|---|---|---|
| | | fluorotitanate and 5 g/l vanadium chloride | | | | | | | | | | | |
| 12 | A | 10.6 g/l potassium fluorotitanate and 5 g/l zinc sulfate heptahydrate | 0.044 | 0.40 | 7 | 2 | 295 | 0 | 60 | Zn | 0.12 | 300 | Example |
| 13 | A | 10.6 g/l potassium fluorotitanate and 5 g/l manganese sulfate pentahydrate | 0.044 | 0.47 | 6 | 2 | 300 | 0 | 20 | Mn | 0.10 | 320 | Example |

TABLE 3

| Surface-treated Steel Sheet Nos. | Plating Processes | Cathodic electrolysis: Bath compositions | Contents of Ti in plating baths (mol/l) | Molar ratios of metal M to Ti in baths | Current density (A/dm$^2$) | Electrolysis time (sec) | Corrosion-resistant coatings Amounts of Ni, Si, and net remaining Sn in coatings (mg/m$^2$): Ni | Sn | Net remaining Sn | Adhesive coatings: Amount of Ti (mg/m$^2$) | Added elements | Mass ratio M/Ti | Thickness (nm) | Remarks |
|---|---|---|---|---|---|---|---|---|---|---|---|---|---|---|
| 14 | B | 10.6 g/l potassium fluorotitanate and 5 g/l cobalt sulfate heptahydrate | 0.044 | 0.040 | 7 | 2 | 80 | 0 | 0 | 60 | Co | 0.10 | 260 | Example |
| 15 | B | 10.6 g/l potassium fluorotitanate and 15 g/l iron sulfate heptahydrate | 0.044 | 1.23 | 7 | 2 | 80 | 0 | 0 | 60 | Fe | 1 | 200 | Example |
| 16 | B | 10.6 g/l potassium fluorotitanate | 0.044 | 0 | 7 | 2 | 80 | 0 | 0 | 60 | Not used | 0 | 70 | Comparative example |
| 17 | C | 10.6 g/l potassium fluorotitanate and 30 g/l cobalt sulfate heptahydrate | 0.044 | 2.43 | 7 | 2 | 80 | 150 | 25 | 60 | Co | 3 | — | Example |
| 18 | C | 10.6 g/l potassium | 0.044 | 1.23 | 7 | 2 | 80 | 300 | 50 | 60 | Fe | 1 | — | Example |

TABLE 3-continued

| Surface-treated Steel Sheet Nos. | Plating Processes | Cathodic electrolysis: Bath compositions | Contents of Ti in plating baths (mol/l) | Molar ratios of metal M to Ti in baths | Current density (A/dm$^2$) | Electrolysis time (sec) | Corrosion-resistant coatings: Amounts of Ni, Si, and net remaining Sn in coatings (mg/m$^2$): Ni | Sn | Net remaining Sn | Adhesive coatings: Amount of Ti (mg/m$^2$) | Added elements | Mass ratio M/Ti | Thickness (nm) | Remarks |
|---|---|---|---|---|---|---|---|---|---|---|---|---|---|---|
| | | fluorotitanate and 15 g/l iron sulfate heptahydrate | | | | | | | | | | | | |
| 19 | C | 10.6 g/l potassium fluorotitanate | 0.044 | 0 | 7 | 2 | 80 | 300 | 50 | 60 | Not used | 0 | — | Comparative example |
| 20 | C | 10.6 g/l potassium fluorotitanate and 30 g/l cobalt sulfate heptahydrate | 0.044 | 2.43 | 7 | 2 | 80 | 500 | 70 | 60 | Co | 3 | — | Example |
| 21 | C | 10.6 g/l potassium fluorotitanate and 15 g/l iron sulfate heptahydrate | 0.044 | 1.23 | 7 | 2 | 80 | 500 | 70 | 60 | Fe | 1 | — | Example |
| 22 | C | 10.6 g/l potassium fluorotitanate | 0.044 | 0 | 7 | 2 | 80 | 500 | 70 | 60 | Not used | 0 | — | Comparative example |

TABLE 4

| Surface-treated Steel Sheet Nos. | Plating Processes | Cathodic electrolysis: Bath compositions | Contents of Ti in plating baths (mol/l) | Molar ratios of metal M to Ti in plating baths | Current density (A/dm$^2$) | Electrolysis time (sec) | Corrosion-resistant coatings: Amounts of Ni, Si, and net remaining Sn in coatings (mg/m$^2$): Ni | Sn | Net remaining Sn | Adhesive coatings: Amount of Ti (mg/m$^2$) | Added elements | Mass ratio M/Ti | Thickness (nm) | Remarks |
|---|---|---|---|---|---|---|---|---|---|---|---|---|---|---|
| 23 | D | 10.6 g/l potassium fluorotitanate and 15 g/l cobalt sulfate heptahydrate | 0.044 | 1.21 | 7 | 2 | 0 | 2000 | 1500 | 60 | Co | 1.8 | 240 | Example |
| 24 | D | 10.6 g/l potassium fluorotitanate and 15 g/l cobalt sulfate heptahydrate | 0.044 | 1.21 | 8 | 2 | 0 | 700 | 300 | 100 | Co | 1.8 | 250 | Example |
| 25 | D | 10.6 g/l potassium fluorotitanate and 15 g/l cobalt sulfate heptahydrate | 0.044 | 1.21 | 5 | 2 | 0 | 500 | 70 | 20 | Co | 1.8 | 100 | Example |
| 26 | D | 10.6 g/l potassium fluorotitanate | 0.044 | 0.41 | 7 | 2 | 0 | 500 | 70 | 60 | Fe | 0.8 | 180 | Example |

TABLE 4-continued

| Surface-treated Steel Sheet Nos. | Plating Processes | Cathodic electrolysis: Bath compositions | Contents of Ti in plating baths (mol/l) | Molar ratios of metal M to Ti in plating baths | Current density (A/dm$^2$) | Electrolysis time (sec) | Corrosion-resistant coatings: Amounts of Ni, Si, and net remaining Sn in coatings (mg/m$^2$): Ni | Sn | Net remaining Sn | Adhesive coatings: Amount of Ti (mg/m$^2$) | Added elements | Mass ratio M/Ti | Thickness (nm) | Remarks |
|---|---|---|---|---|---|---|---|---|---|---|---|---|---|---|
| | | and 5 g/l iron sulfate heptahydrate | | | | | | | | | | | | |
| 27 | D | 10.6 g/l potassium fluorotitanate and 10 g/l nickel sulfate hexahydrate | 0.044 | 0.86 | 7 | 2 | 0 | 500 | 70 | 60 | Ni | 0.05 | 150 | Example |
| 28 | D | 10.6 g/l potassium fluorotitanate and 5 g/l iron chloride anhydrate | 0.044 | 0.57 | 7 | 2 | 0 | 1500 | 900 | 60 | Fe | 0.8 | 180 | Example |
| 29 | D | 10.6 g/l potassium fluorotitanate | 0.044 | 0 | 7 | 2 | 0 | 700 | 300 | 60 | Not used | 0 | 100 | Comparative Example |
| 30 | No plating (on steel sheet) | 10.6 g/l potassium fluorotitanate and 15 g/l cobalt sulfate heptahydrate | 0.044 | 1.21 | 7 | 2 | 0 | 0 | 0 | 60 | Co | 1.8 | 240 | Example |
| 31 | No plating (on steel sheet) | 10.6 g/l potassium fluorotitanate and 5 g/l iron sulfate heptahydrate | 0.044 | 0.41 | 7 | 2 | 0 | 0 | 0 | 60 | Fe | 0.8 | 150 | Example |

TABLE 5

| Surface-treated Steel Sheet Nos. | Adhesive coatings: Line density of protruding portions (per μm) | Area density of protruding portions (per μm$^2$) | Rq/Ra | Rsk | Rku | Remarks |
|---|---|---|---|---|---|---|
| 1 | <1.0 | 14 | 1.32 | 0.80 | 4.3 | Comparative Example |
| 8 | 3.4 | 22 | 1.24 | 0.28 | 3.2 | Example |
| 9 | 2.9 | 26 | 1.27 | 0.42 | 4.1 | Example |
| 10 | 2.0 | 20 | 1.22 | 0.62 | 3.8 | Example |
| 11 | 3.5 | 27 | 1.23 | 0.36 | 3.5 | Example |
| 12 | 2.3 | 19 | 1.18 | 0.81 | 4.5 | Example |
| 13 | 4.0 | 28 | 1.31 | 0.32 | 3.6 | Example |
| 15 | 2.2 | 20 | 1.25 | 0.51 | 3.5 | Example |
| 16 | <1.0 | 15 | 1.32 | 0.75 | 4.2 | Comparative Example |
| 26 | 2.0 | 18 | 1.20 | 0.55 | 3.1 | Example |
| 27 | 2.3 | 17 | 1.20 | 0.61 | 3.5 | Example |
| 28 | 2.1 | 20 | 1.21 | 0.54 | 3.2 | Example |
| 29 | <1.0 | 14 | 1.35 | 0.80 | 4.3 | Comparative Example |
| 31 | 2.2 | 15 | 1.30 | 0.55 | 3.6 | Example |

TABLE 6

| Laminated Steel Sheet Nos. | humid resin adhesion: strip length (mm) | Remarks |
|---|---|---|
| 1 | 50 | Comparative Example |
| 2 | 5 | Example |
| 3 | 6 | Example |
| 4 | 7 | Example |
| 5 | 8 | Example |
| 6 | 9 | Example |
| 7 | 7 | Example |
| 8 | 8 | Example |
| 9 | 9 | Example |
| 10 | 9 | Example |
| 11 | 8 | Example |
| 12 | 9 | Example |
| 13 | 9 | Example |
| 14 | 7 | Example |
| 15 | 9 | Example |
| 16 | 14 | Comparative Example |
| 17 | 6 | Example |
| 18 | 7 | Example |
| 19 | 70 | Comparative Example |
| 20 | 8 | Example |
| 21 | 9 | Example |
| 22 | 70 | Comparative Example |
| 23 | 9 | Example |
| 24 | 8 | Example |
| 25 | 7 | Example |
| 26 | 8 | Example |
| 27 | 8 | Example |

TABLE 6-continued

| Laminated Steel Sheet Nos. | humid resin adhesion: strip length (mm) | Remarks |
|---|---|---|
| 28 | 8 | Example |
| 29 | 70 | Comparative Example |
| 30 | 7 | Example |
| 31 | 6 | Example |

INDUSTRIAL APPLICABILITY

According to the present invention, a surface-treated steel sheet which contains no Cr and which is excellent in wet resin adhesion can be produced. The surface-treated steel sheet according to the present invention can be used as an alternative to a conventional tin-free steel sheet with no problem and can be used for containers for storing oils, organic solvents, or paints without being coated with resin. If a resin-coated steel sheet produced by coating the surface-treated steel sheet with resin is formed into cans or can lids and the cans or can lids are exposed to a retort atmosphere, no resin is peeled off.

The invention claimed is

1. A surface-treated steel sheet comprising:

an oxygen-containing adhesive layer having a thickness of 20 to 800 nm and which is disposed on at least one surface of the steel sheet and which contains Ti and at least one selected from the group consisting of Co, Fe, Ni, V, Cu, Mn, and Zn, a ratio of the total amount of Co, Fe, Ni, V, Cu, Mn, and Zn to the amount of Ti contained therein being 0.01 to ten on a mass basis, the adhesive layer having been obtained by cathodically electrolyzing in an aqueous solution, and the adhesive layer has bumps arranged with an area density of 16 or more per $\mu m^2$ and the area density of the bumps of the adhesive layer is defined as a number of the bumps that are 0.005 μm or more higher than an average line of the bumps and recessed portions, the average line being determined from a SEM image of the layer observed with a scanning electron microscope (SEM) that is three-dimensionally analyzed and filtered at a cut-off wavelength of 1.0 μm.

2. The surface-treated steel sheet according to claim 1, wherein the bumps are arranged with a line density of one or more per μm, the thickness of the adhesive layer is defined as a maximum height H from a lower surface of the adhesive layer to the bumps in a cross-sectional profile of the layer observed with a transmission electron microscope (TEM), and the line density of the bumps is defined as the number of the bumps per unit length, the number thereof being determined on an assumption that one of the bumps is present when one or more intersections of an upper-level horizontal line and a profile curve are present between two adjacent intersections of a lower-level horizontal line and the profile curve, the upper- and lower-level horizontal lines being ±10 nm apart from a center line located at a position given by the formula (H+L)/2, where L represents a minimum height from the lower surface of the adhesive layer to a bottom of a recessed portion.

3. The surface-treated steel sheet according to claim 2, wherein the amount of Ti in the adhesive layer is 3 to 200 $mg/m^2$ per one surface.

4. The surface-treated steel sheet according to claim 1, wherein a ratio (Rq/Ra) of root-mean-square roughness (Rq) to arithmetic average roughness (Ra) is 1.3 or less, the root-mean-square roughness and the arithmetic average roughness being specified in JIS B 0601:2001 and being determined in such a manner that a cross-sectional curve is derived from three-dimensional data obtained with a SEM and then filtered at a cut-off wavelength of 1.0 μm.

5. The surface-treated steel sheet according to claim 4, wherein skewness (Rsk) is 0.6 or less or kurtosis (Rku) is four or less, the skewness and the kurtosis being specified in JIS B 0601:2001 and being determined in such a manner that a cross-sectional curve is derived from three-dimensional data obtained with a SEM and then filtered at a cut-off wavelength of 1.0 μm.

6. The surface-treated steel sheet according to claim 4, wherein the amount of Ti in the adhesive layer is 3 to 200 $mg/m^2$per one surface.

7. The surface-treated steel sheet according to claim 1, wherein skewness (Rsk) is 0.6 or less or kurtosis (Rku) is four or less, the skewness and the kurtosis being specified in JIS B 0601:2001 and being determined in such a manner that a cross-sectional curve is derived from three-dimensional data obtained with a SEM and then filtered at a cut-off wavelength of 1.0 μm.

8. The surface-treated steel sheet according to claim 1, wherein the amount of Ti in the adhesive layer is 3 to 200 $mg/m^2$ per one surface.

9. The surface-treated steel sheet according to claim 1, further comprising a corrosion-resistant layer which is disposed on at least one surface of the steel sheet; which includes at least one selected from the group consisting of a Ni layer, a Sn layer, a Fe—Ni alloy layer, a Fe—Sn alloy layer, and a Fe—Ni—Sn alloy layer; and which is disposed under the adhesive layer.

10. The surface-treated steel sheet according to claim 1, coated with resin.

11. A surface-treated steel sheet comprising:

an oxygen-containing adhesive layer which is disposed on at least one surface of the steel sheet and which contains Ti and at least one selected from the group consisting of Co, Fe, Ni, V, Cu, Mn, and Zn, a ratio of the total amount of Co, Fe, Ni, V, Cu, Mn, and Zn to the amount of Ti contained therein being 0.01 to ten on a mass basis, the adhesive layer having been obtained by cathodically electrolyzing in an aqueous solution, wherein the adhesive layer has a thickness of 20 to 800 nm and also has bumps which are arranged with a line density of one or more per μm, the thickness of the adhesive layer is defined as a maximum height H from a lower surface of the adhesive layer to the bumps in a cross-sectional profile of the layer observed with a transmission electron microscope (TEM), and the line density of the bumps is defined as the number of the bumps per unit length, the number thereof being determined on an assumption that one of the bumps is present when one or more intersections of an upper-level horizontal line and a profile curve are present between two adjacent intersections of a lower-level horizontal line and the profile curve, the upper- and lower-level horizontal lines being ±10 nm apart from a center line located at a position given by the formula (H+L)/2 , where L represents a minimum height from the lower surface of the adhesive layer to a bottom of a recessed portion.

12. The surface-treated steel sheet according to claim 11, wherein the amount of Ti in the adhesive layer is 3 to 200 $mg/m^2$ per one surface.

13. The surface-treated steel sheet according to claim 11, further comprising a corrosion-resistant layer which is disposed on at least one surface of the steel sheet; which includes at least one selected from the group consisting of a Ni layer, a Sn layer, a Fe—Ni alloy layer, a Fe—Sn alloy layer, and a Fe—Ni—Sn alloy layer; and which is disposed under the adhesive layer.

14. The surface-treated steel sheet according to claim 11, coated with resin.

* * * * *